US006209627B1

(12) United States Patent
Hasumi

(10) Patent No.: US 6,209,627 B1
(45) Date of Patent: Apr. 3, 2001

(54) COOLING DEVICE FOR RADIATOR OF MOTORCYCLE

(75) Inventor: Hiroaki Hasumi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/168,157

(22) Filed: Oct. 8, 1998

(30) Foreign Application Priority Data

Oct. 8, 1997 (JP) ..... 9-276045

(51) Int. Cl.[7] ..... F28F 13/12

(52) U.S. Cl. ..... 165/122; 165/125; 123/41.49; 123/41.65; 180/68.1; 416/189

(58) Field of Search ..... 165/121, 146, 165/122, 147, 125, 41, 119; 123/41.49, 41.65; 180/68.1; 416/189, 192

(56) References Cited

U.S. PATENT DOCUMENTS

| | | | | |
|---|---|---|---|---|
| 3,842,902 | * | 10/1974 | Poslusny | 165/122 X |
| 4,685,513 | * | 8/1987 | Longhouse et al. | 165/121 |
| 4,768,472 | * | 9/1988 | Hayashi et al. | 123/41.49 |
| 4,934,449 | * | 6/1990 | Watt et al. | 165/119 X |
| 5,131,352 | * | 7/1992 | Hoshino et al. | 123/41.49 |
| 5,183,382 | * | 2/1993 | Carroll | 416/189 X |
| 5,242,013 | * | 9/1993 | Couëtoux et al. | 165/121 |
| 5,342,173 | * | 8/1994 | Vera | 416/192 X |
| 5,460,485 | * | 10/1995 | Sugiyama et al. | 123/41.49 X |
| 5,597,038 | * | 1/1997 | Potier | 165/121 |
| 5,868,197 | * | 2/1999 | Potier | 165/121 |
| 5,996,685 | * | 12/1999 | Alizadeh | 165/121 |
| 6,106,230 | * | 8/2000 | Burgess | 416/189 X |

FOREIGN PATENT DOCUMENTS

| | | | | |
|---|---|---|---|---|
| 881454 | * | 6/1953 | (DE) | 416/192 |
| 175922 | * | 3/1922 | (GB) | 416/189 |
| 177047 | * | 3/1922 | (GB) | 416/192 |

* cited by examiner

*Primary Examiner*—Christopher Atkinson
(74) *Attorney, Agent, or Firm*—Birch, Stewart, Kolasch, Birch, LLP

(57) ABSTRACT

To reduce noise caused by exhausted cooling air as well as to maintain a necessary amount of cooling air of a cooling fan. A cooling fan is positioned behind a radiator. A shroud surrounds an impeller coupled to a motor and a rotating shaft. The shroud has an inlet and an outlet in the shape of a bell mouth. The bell mouth shaped inlet has its front edge spaced from the rear surface of the radiator by a clearance D, and forms a space around its front peripheral edge. A space is formed via the space, and opens around the periphery of the shroud. The ratio A:B is 1:3 to 5, preferably approximately 1:4, where A denotes a difference between maximum and minimum diameters of the bell mouth shaped outlet of the shroud, and B notes a length of the shroud.

16 Claims, 11 Drawing Sheets

COOLING DEVICE FOR RADIATOR OF MOTORCYCLE

BACKGROUND OF THE INVENTION

1. Field of the Invention

The present invention relates to a radiator for a motorcycle for reducing noise caused by exhausted cooling air.

2. Description of Background Art

Japanese Utility Model Laid-Open Publication No. Hei 1-162033 discloses a cooling device for a radiator for a motorcycle, in which a cooling fan is positioned at an outlet for the radiator cooling air, and a cylindrical shroud surrounds an impeller for the cooling fan. The shroud has its front open end coupled to the rear periphery of the radiator, and houses a cooling fan at a rear portion. Further, an outlet of the shroud is in the shape of a bell mouth. In the present invention, the front, rear, left and right directions denote directions viewed in the plane which confronts flow of cooling air to the radiator, and an upward and downward direction denote the directions viewed from the position where the radiator is installed.

A shroud surrounding a cooling fan for a radiator is effective in reliably maintaining an amount of cooling air while a motorcycle is stationary and idling or while it is operating at low speeds. However, cooling air flowing through the shroud generates noise. Such noise can be reduced to a certain degree when the shroud uses a bell mouth structure. Since the cooling device of the motorcycle is usually exposed, it has been required to reduce the noise caused by exhausted cooling air as demand for quiet driving has been on the rise recently. Therefore, a cooling device for a radiator of a motorcycle has to not only obtain a necessary amount of cooling air but also reduce the noise resulting from exhausted cooling air.

A radiator is usually cooled by airstreams caused by a moving motorcycle. When the radiator has its rear surface covered by the shroud as in the foregoing publication, cooling air passing through the radiator cannot easily flow outwardly. Therefore, it is also required to improve cooling efficiency while the motorcycle is operating.

SUMMARY AND OBJECTS OF THE INVENTION

The presence of stays for mounting a cooling fan motor also affects such noise. A main object of the invention is to provide a cooling device for a radiator of a motorcycle that can reduce noise caused by exhausted cooling air, and a further object is to improve the cooling efficiency of the radiator while the motorcycle is operating.

In order to solve the foregoing problems, according to a first feature of the invention, a cooling device for a radiator of a motorcycle comprises a cooling fan positioned at a cooling air outlet of the radiator and a cylindrical shroud surrounding an impeller of the cooling fan. The cylindrical shroud has an inlet and an outlet which are in the shape of a bell mouth. The bell mouth shaped inlet is positioned near the rear surface of the radiator with a space maintained therebetween. Further, the space which opens around the shroud is provided between the bell mouth shaped inlet and the rear surface of the radiator.

In accordance with a second feature, a difference between a maximum diameter and a minimum diameter of the bell mouth shaped outlet of the shroud and a length of the shroud is in the ratio of 1:3 to 5.

In a third feature, a cooling device for a radiator of a motorcycle comprises a cooling fan positioned at a cooling air outlet of the radiator and a cylindrical shroud surrounding an impeller of the cooling fan. A bell mouth shaped inlet of the shroud positioned near the rear surface of the radiator with a space maintained therebetween, and the shroud is structured to rotate integrally with the impeller of the cooling fin.

In accordance with a fourth feature, the shroud has any one or both of an inlet or an outlet thereof in the shape of a bell mouth.

According a fifth feature, a difference between a maximum diameter and a minimum diameter of the ball-mouth-shaped outlet of the shroud and a length of the shroud is in the ratio of 1:3 to 5.

In a sixth feature, a cooling device for a radiator of a motorcycle comprises a cooling fan positioned at a cooling air outlet of the radiator, and a motor for driving the cooling fan and supported to the radiator using a plurality of motor mounting stays. All of the stays are inclined in the rotating direction of an impeller of the cooling fan.

According to a seventh feature, a cooling device for a radiator of a motorcycle comprises a cooling fan positioned at a cooling air outlet of the radiator, and a motor for driving the cooling fan and supported on the radiator using a plurality of motor mounting stays. All of the motor mounting stays are in the shape of a flat plate and inclined in a direction where exhausted cooling air is discharged.

According to a first feature of the invention, the shrouds has its inlet and outlet in the shape of a bell mouth. The bell mouth shaped inlet of the shroud is spaced from the rear surface of the radiator, and the open space is provided around the shroud. Therefore, it is possible to obtain a necessary amount of cooling air during the operation of the motorcycle, and to reduce the noise caused by exhausted cooling air while the motorcycle is stationary and idling, or while it is operating at low speeds, as well as obtaining a necessary amount of cooling air.

A part of exhausted cooling air that passes through the radiator of the operating motorcycle and overflows the shroud is effectively discharged outside via the open space. This promotes smooth flow of cooling air regardless of the shroud, and is effective in improving cooling efficiency and reducing noise caused by exhausted cooling air. A necessary amount of cooling air can be obtained when the motorcycle is stationary and idling, or when it is operating at low speeds. The bell mouth shaped inlet and outlet of the shroud contribute to the reduction of noise caused by exhausted cooling air.

In the second feature, the difference between a maximum diameter and a minimum diameter of the bell mouth shaped outlet of the shroud and a length of the shroud is in the ratio of 1:3 to 5. This ratio is effective in obtaining a necessary amount of cooling air and in reducing noise caused by exhausted cooling air, and can be set in a range optimum for manufacturing of the cooling device.

According to the third feature of the invention, the shroud rotates integrally with the impeller of the cooling fan, which means that there is no clearance between the shroud and the impeller. This extensively promotes the reduction of noise caused by exhausted cooling air, and accelerates exhausted cooling air. Further, since the bell mouth shaped inlet of the shroud is spaced from the rear surface of the radiator, it is possible to discharge exhausted cooling air that overflows the shroud, and to enable the shroud to rotate integrally with the impeller. Still further, the motor mounting stays can support the motor on the radiator without mounting via the shroud, which makes the mounting structure simple and light in weight.

In a fourth feature of the invention, either or both of the inlet and outlet of the shroud is in the shape of a bell mouth, which is effective in reducing noise caused by exhausted cooling air.

In the fifth feature, the difference between a maximum diameter and a minimum diameter of the bell mouth shaped outlet of the shroud and a length of the shroud is in the ratio of 1:3 to 5. This ratio is effective in obtaining a necessary amount of cooling air and in reducing noise caused by exhausted cooling air, and can be set in a range optimum for the manufacturing of the cooling device.

According to a sixth feature of the invention, all the stays are inclined in the rotating direction of the impeller, so that exhausted cooling air from the cooling fan comes into smooth contact with the stays. This is effective in reducing noise caused by exhausted cooling air.

In a seventh feature of the invention, the stays are in the shape of a flat plate, and are inclined in the direction in which exhausted cooling air flows from the radiator. This enable cooling air to come into smooth contact with the stays, reduce noise caused by exhausted cooling air, and guide exhausted cooling air in a predetermined direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
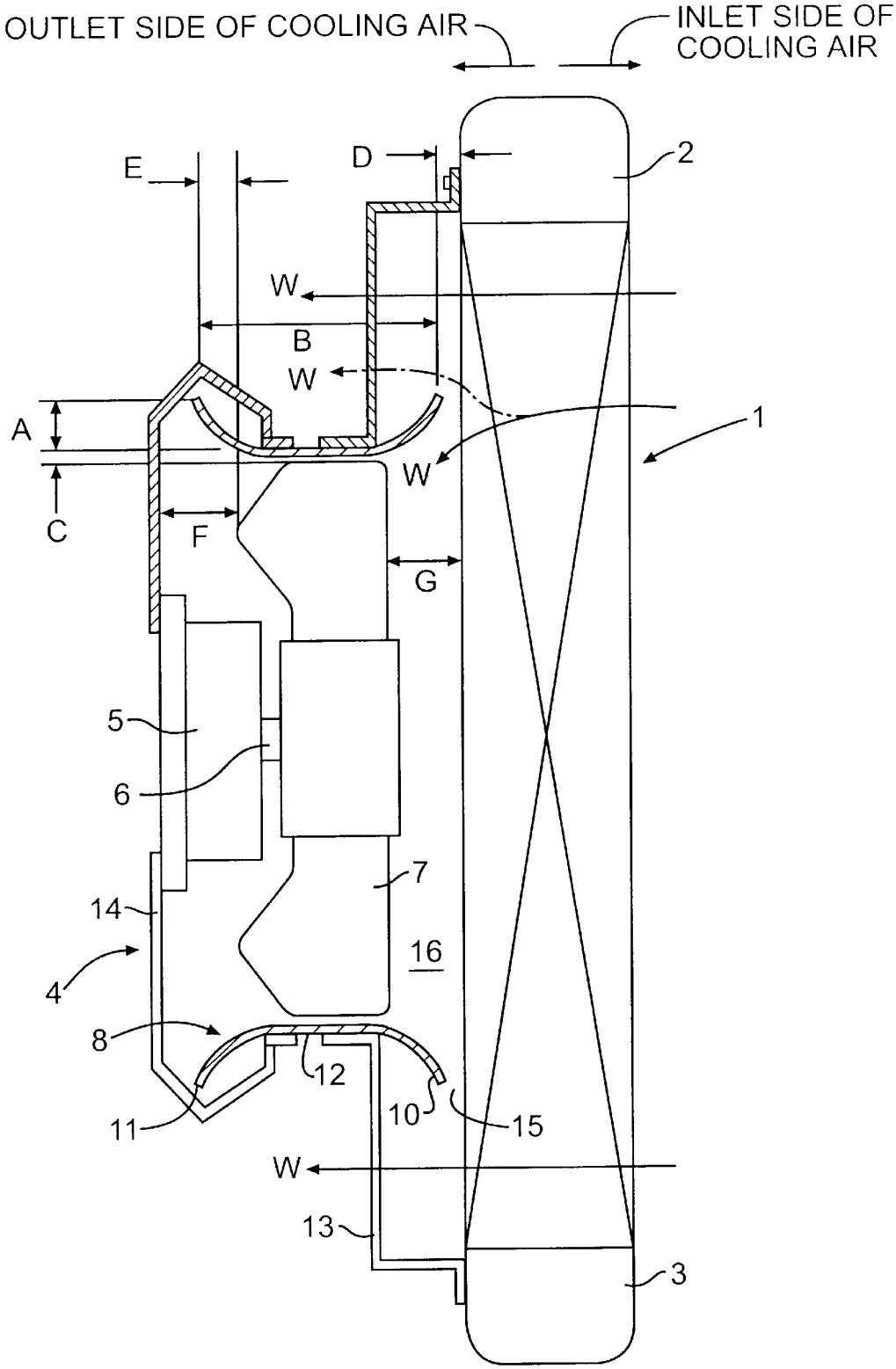
FIG. 1 is a schematic cross-sectional view of the radiator of the motorcycle.

A first embodiment of the invention will be described with reference to FIGS. 1 to 4. Referring to the drawings, the radiator 1 is a well-known type, and includes an upper tank 2, a lower tank 3, and a cooling fan 4 on the rear side. The cooling fan 4 has a motor 5, and an impeller 7 coupled thereto via a rotation shaft 6. A cylindrical shroud 8 surrounds the impeller 7.

The shroud 8 has an inlet 10 and an outlet 11 which are in the shape of a bell mouth, and a straight portion 12 extending between the inlet 10 and outlet 11. The bell mouth shaped inlet 10 and outlet 11 contribute to the reduction in noise caused by exhausted cooling air and the acceleration of exhausted cooling air. The straight portion 12 is lengthened in order that the bell mouth shaped outlet 11 can smoothly spread cooling air towards the rear portion of the motorcycle even when a space behind the impeller 7 is narrow.

A plurality of stays 13 extend between the front periphery of the shroud 8, and are spaced apart from one another by 120°. The stays 13 are attached to the rear surface of the upper tank 2 or the lower tank 3 of the radiator, using bolts or the like.

Further, a plurality of stays 13 (three stays in this embodiment) are attached to the rear periphery of the shroud 8, and are spaced apart from one another by 120°. The stays 13 extend around the bell mouth shaped outlet 11 at their intermediate parts, and are fixed to the rear surface of the motor 5 by welding or the like.

Referring to FIG. 1, the front edge of the bell mouth shaped inlet 10 is spaced from the rear surface of the radiator 1 by a distance D. This allows a clearance 15 to be provided along the front edge of the inlet 10, and a space 16 communicating with the clearance 15 to be formed inside the inlet 10. The space 16 opens around the shroud 8.

The bell mouth shaped extent A of the outlet 11 is as large as the bell mouth shaped extent of the inlet 10. The extent A has a fixed relationship with a length B of the shroud 8, and is approximately in the ratio of 1:4.

The impeller 7 has a depth which is substantially equal to a length of the straight portion 12, and is spaced from the rear surface of the radiator 1 by a distance G (G>D), at the front edges thereof. Further, the impeller 7 is spaced from the motor mounting stays 14 by a distance F which is larger than the length E of the bell mouth shaped outlet 11. A clearance C is maintained between the inner surface of the straight portion 12 and the impeller 7.

Figure 2:
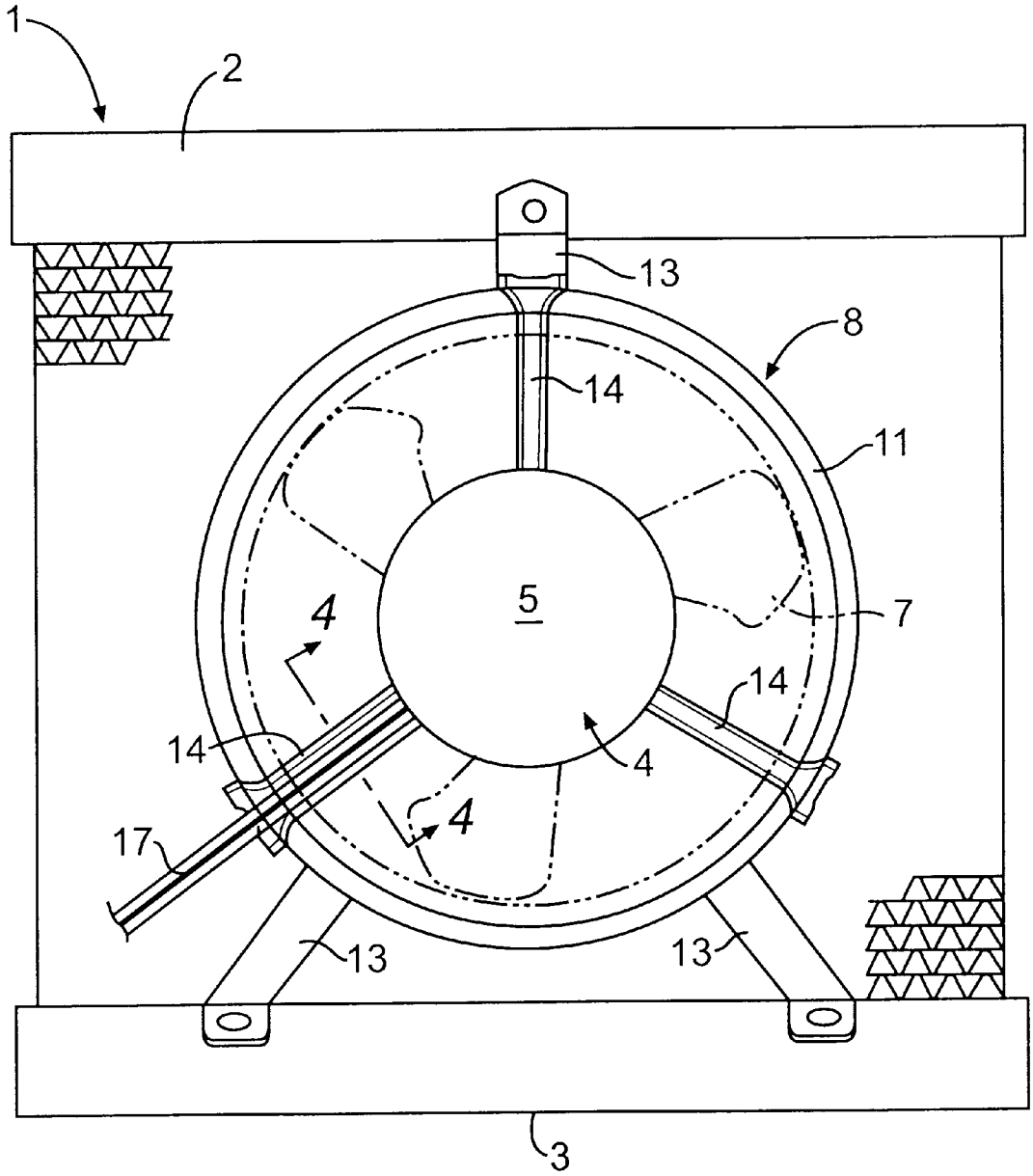
FIG. 2 is a rear view of the radiator in FIG. 1.
Figure 3:
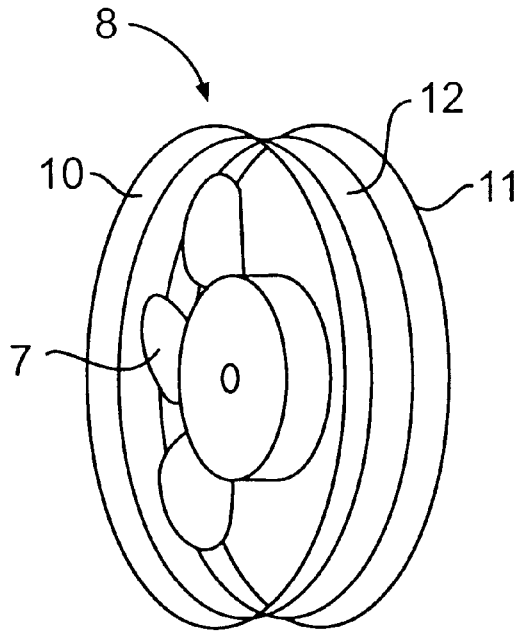
FIG. 3 is a perspective view of the shroud.
Figure 4:
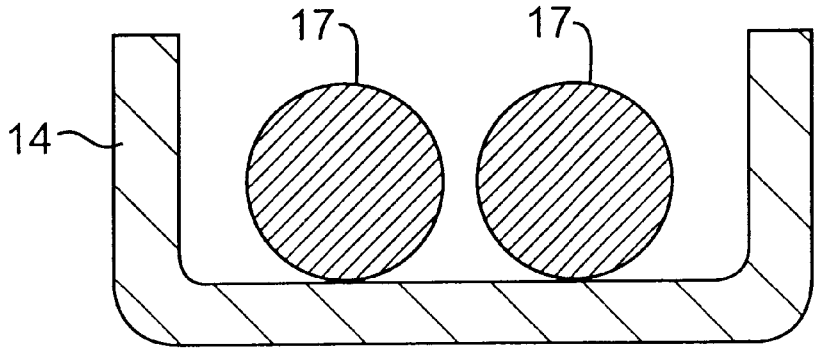
FIG. 4 is a sectional view taken along line 4—4 in FIG. 2.

As shown in FIGS. 2 and 4, the motor mounting stays 14 are substantially in the shape of the letter U (as clearly shown in FIG. 4), with open tops facing rearwardly. Two out of three motor mounting stays 14 spaced apart by 120° are narrower than the remaining one.

Power source cords 17 are laid in the U-shaped portion of the wide motor mounting stay 14 such that they do not project from the motor mounting stay 14 (see FIG. 4).

The motor mounting stays 14 should be arranged so as not to adversely effect cooling air supplied rearwardly by the cooling fan. The distance F between the rear end of the impeller 7 and the motor mounting stays 14 should be as large as possible. Therefore, the motor mounting stays 14 are preferably attached to the outer periphery of the shroud 8.

The cross-sectional area of the motor mounting stays 14 that is orthogonal to a streamline of exhausted cooling air is important, and should be minimized as possible. In this respect, it is most preferable that the motor mounting stays 14 are in the shape of a flat plate. Alternatively, the motor mounting stays 14 may be cylindrical or have a U-shaped cross section. When the motor mounting stays 14 are U-shaped, they preferably have their open top facing rearwardly as in this embodiment.

The parameters A to G that contribute to a reduction in noise caused by exhausted cooling air are determined in the following manner. The following description is based on results obtained by measuring the velocity and sound pressure of exhausted cooling air that passed through the shroud, assuming that the measurements are carried out under the same conditions for each component.

Figure 5:
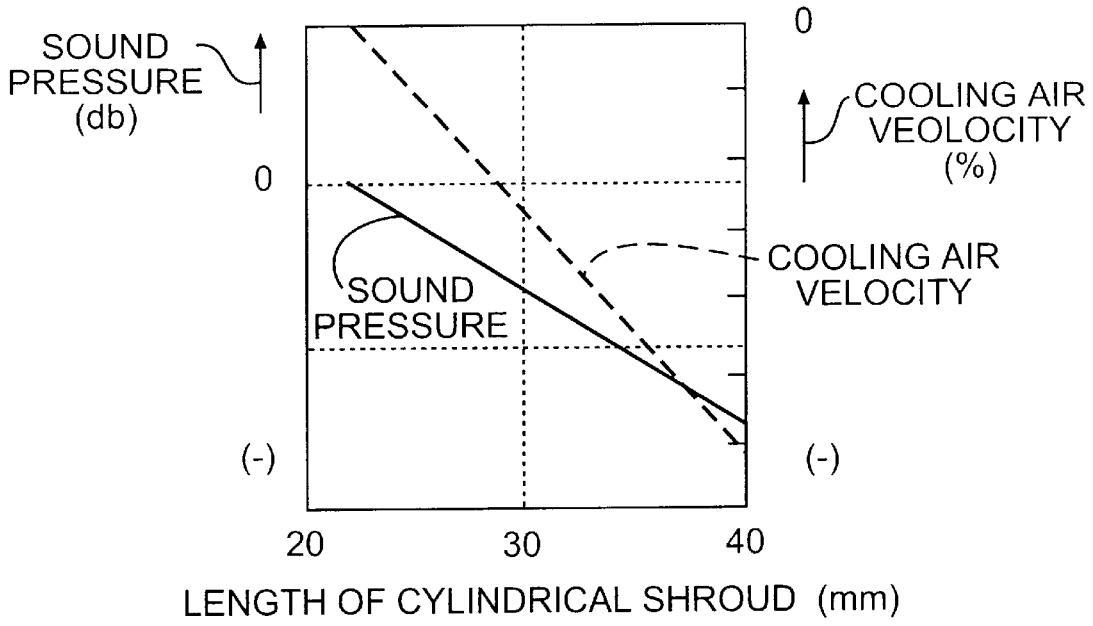
FIG. 5 is a graph showing variations of velocity of cooling air and sound pressure depending upon the length of the straight portion 12.

FIG. 5 is a graph showing the general tendencies in the variations of velocity and sound pressure of cooling air passing through the shroud 8 in accordance with a length thereof. The longer the shroud 8, the more efficiently sound pressure is reduced and the velocity of the cooling air is lowered. Therefore, both the sound pressure and the velocity of the cooling air are most efficiently reduced when the shroud 8 is approximately 40 mm long where two lines intersect.

Figure 6:
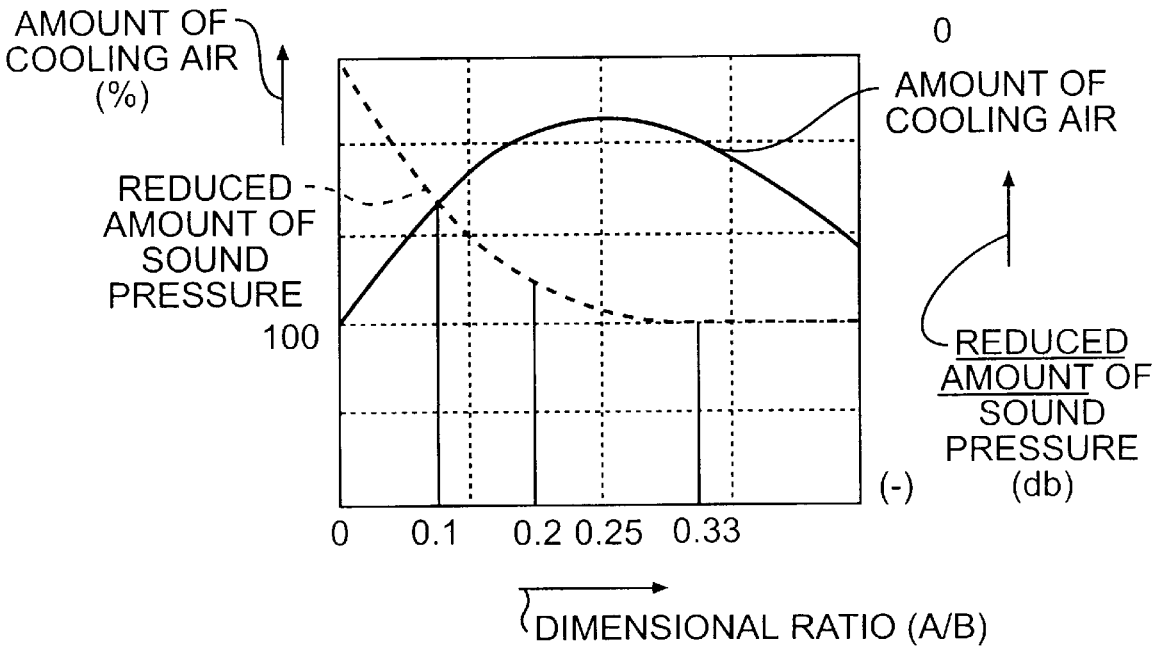
FIG. 6 is a graph showing variations in the amount of cooling air and reduction of sound pressure depending upon variations of the clearances A and B.

FIG. 6 shows the effects of the bell mouth shaped portion. In this case, the length B of the shroud 8 is 40 mm. Specifically, FIG. 6 is a graph showing the general tendencies of a variation in an amount of cooling air (when A=0 is considered to be 100% of an ordinary amount of air, the amount of cooling air is proportional to the velocity of cooling air) and a variation or reduction of sound pressure (when A=0 is assumed to be 0 db), when the ratio of A and B is varied. The sound pressure can be most efficiently reduced between a range where A:B is approximately 1:10 (equivalent to approximately 0.1 on the abscissa of FIG. 6) where two curves intersect and a range where A:B is approximately 1:3–5 (equivalent to approximately 0.33–0.2 on the abscissa of FIG. 6).

The range where the ratio (A:B) is 1:3–5 is most effective to obtain the required amount of cooling air using the shroud and to reduce noise caused by exhausted cooling air. Specifically, the range is very advantageous for the actual use. In other words, the less curved the bell mouth shaped portion, it is difficult to manufacture this portion actually. The ratio A:B is 1:5 (equivalent to 0.2 in FIG. 6), which is a lower limit of a range which is advantageous to the actual manufacturing process. Conversely, when the ratio A:B is approximately 1:3 or more, the effect of noise reduction substantially remains the same. Only the bell mouth shaped portion becomes larger, which is disadvantageous with respect to size and weight of the shroud. The most preferable range is approximately 1:4 (equivalent to 0.25 in FIG. 6), where sound pressure can be most efficiently reduced, and cooling air can be obtained as desired in this range.

Needless to say, the bell mouth shaped outlet 11 is very important. When the bell mouth shaped outlet 11 is made wider at its rear end, exhausted cooling air can be dispersed rearwardly more smoothly. Otherwise, wind noise will be increased.

Figure 7:
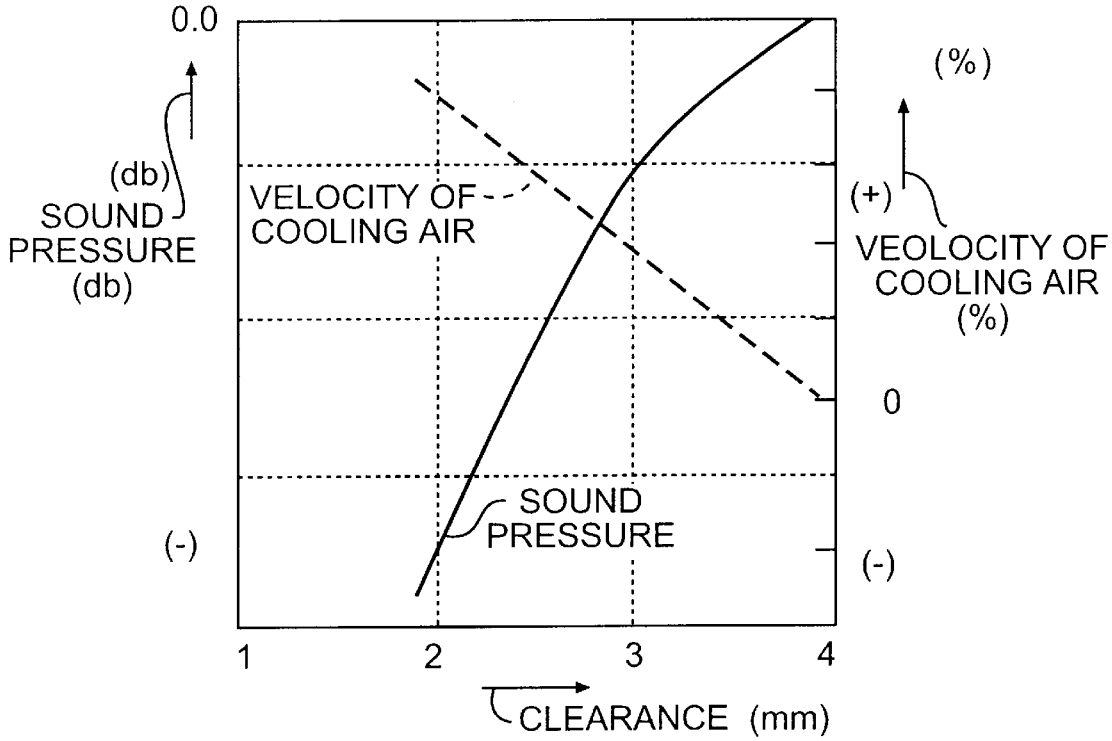
FIG. 7 is a graph showing variations in the amount of cooling air and the reduction of sound pressure depending upon the variations in the clearance between the impeller and the straight portion.

FIG. 7 is a graph showing the general tendencies of a variation in the velocity and sound pressure as the clearance C varies between the edge of the impeller 7 and the straight portion 12. The smaller the clearance C, the more extensively the velocity is increased, and sound pressure of exhausted cooling air is reduced.

Therefore, the clearance C should be as minimum as possible, and depends upon factors such as molding precision and so on. The use of a precisely molded resin shroud is effective in minimizing the clearance C as possible.

If the clearance D between the bell mouth shaped inlet 10 and the rear surface of the radiator 1 is too small, noise will be caused by exhausted cooling air. Conversely, the larger the clearance D, the more extensively the amount of cooling air is reduced. Therefore, the clearance D should be several millimeters long, e.g. preferably 2 to 3 millimeters.

The clearance E should be equal to or more than O between the rear edge of the impeller 7 and the rear edge of the bell mouth shaped outlet 11. If the rear edge of the impeller 7 projects out of the rear edge of the outlet 11, wind noise will be increased.

The larger the clearance G between the front edge of the impeller 7 and the rear surface of the radiator 1, the more extensively cooling air noise can be reduced. If the front edge of the impeller 7 projects from the area defined by the straight portion 12 of the shrouds, cooling air noise will become large. Therefore, measures should be taken to prevent the front edge of the impeller 7 from extending to the bell mouth shaped inlet 10.

Figure 8:
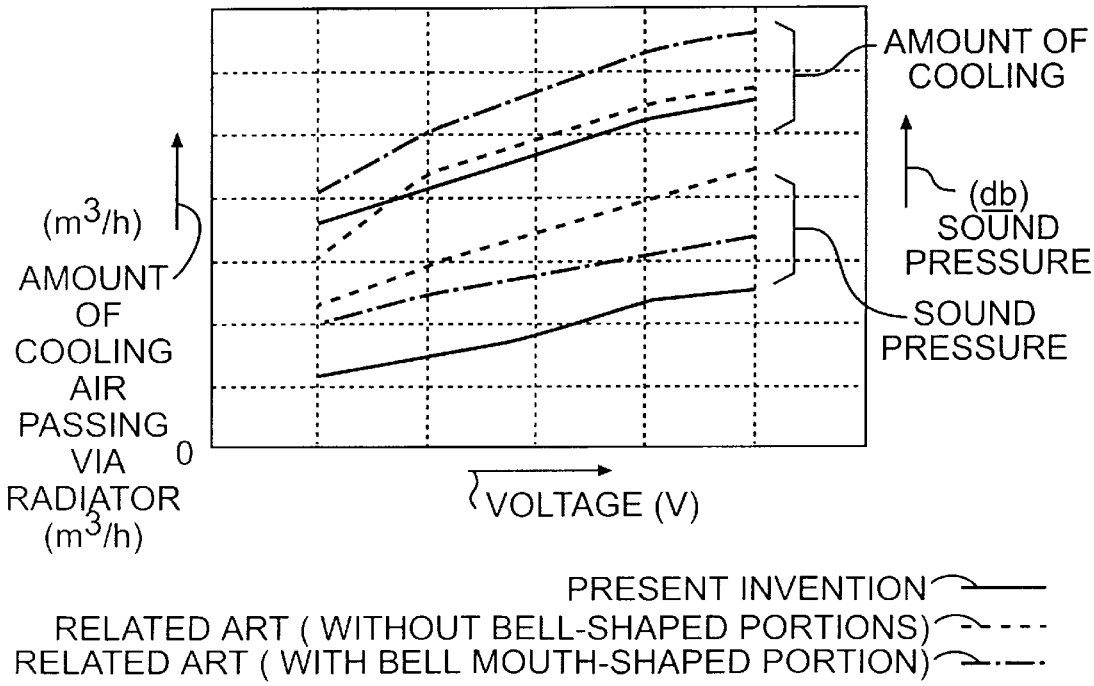
FIG. 8 is a graph showing the effects of the present invention depending upon variations of a voltage supplied to the cooling fan rotating motor.

The operation of the cooling device in this embodiment will be described hereinafter. FIG. 8 a graph showing the variations in the amount of exhausted cooling air and sound pressure behind the shroud 8 when a voltage applied to the motor 5 is varied in a finished motorcycle to which the radiator of the present invention is applied. Specifically, FIG. 8 shows a comparison of the foregoing variations of the cooling device of the present invention, an example of the related art cooling device without the bell mouth shaped portions, and an example of the related art cooling device that includes a bell mouth shaped portion but the rear surface of the radiator is covered by the shroud.

As can be seen in FIG. 8, the amount of air passing through the radiator in the present invention is substantially equal to the amount of air of the related art cooling devices. However, the sound pressure is sufficiently reduced to a level which is not uncomfortable to the rider. Therefore, the amount of cooling air can be maintained as usual while the sound pressure can be extensively reduced.

Figure 9:
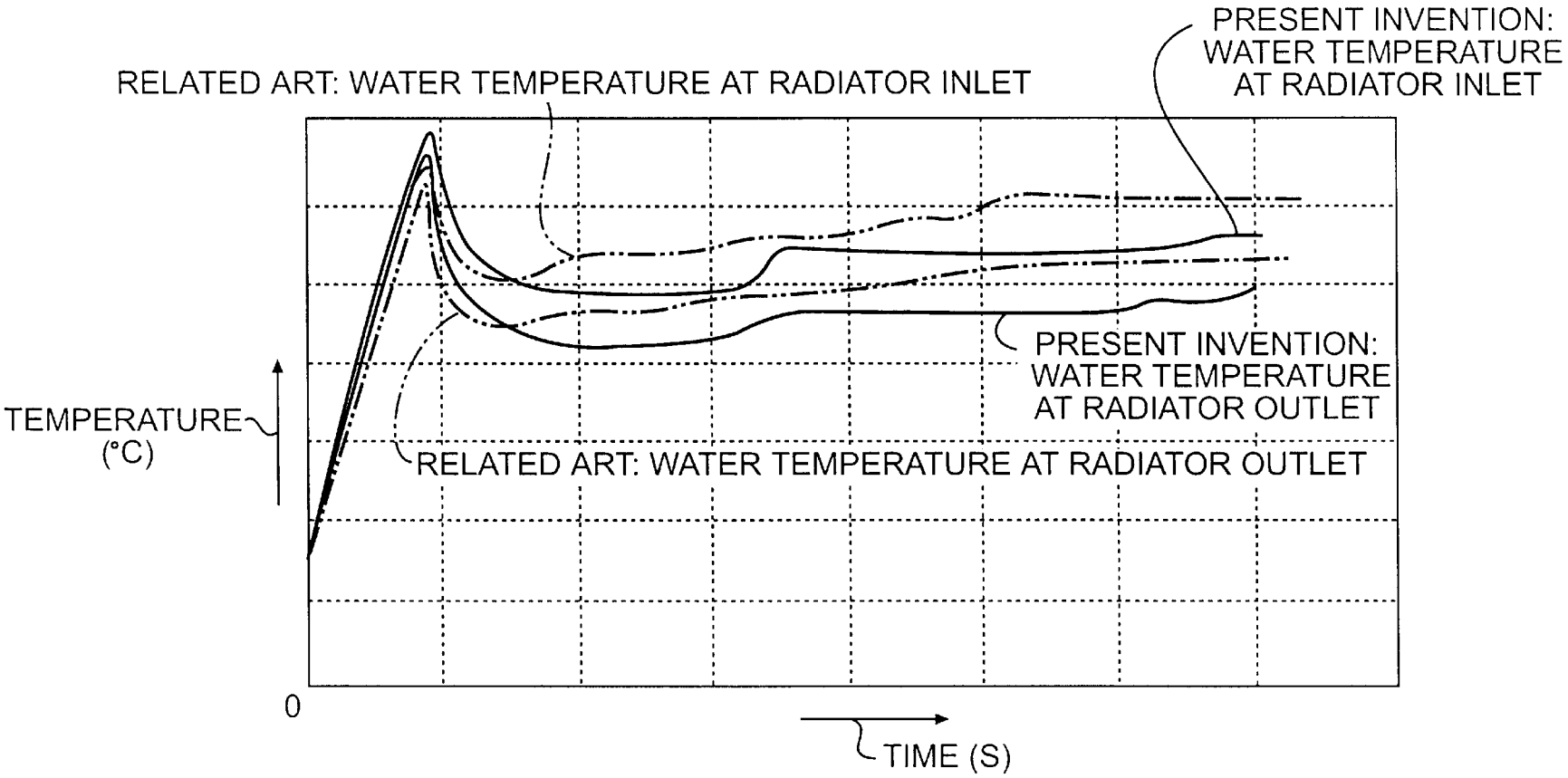
FIG. 9 shows variations in water temperature of the radiator.

FIG. 9 is another graph showing a temperature variation of cooling water at an inlet and an outlet of the radiator of the present invention in a finished motorcycle, compared with a temperature variation in a conventional radiator without a bell mouth shaped shroud. As clearly shown in FIG. 9, the embodiment of the invention assures improved cooling efficiency.

Figure 10A:
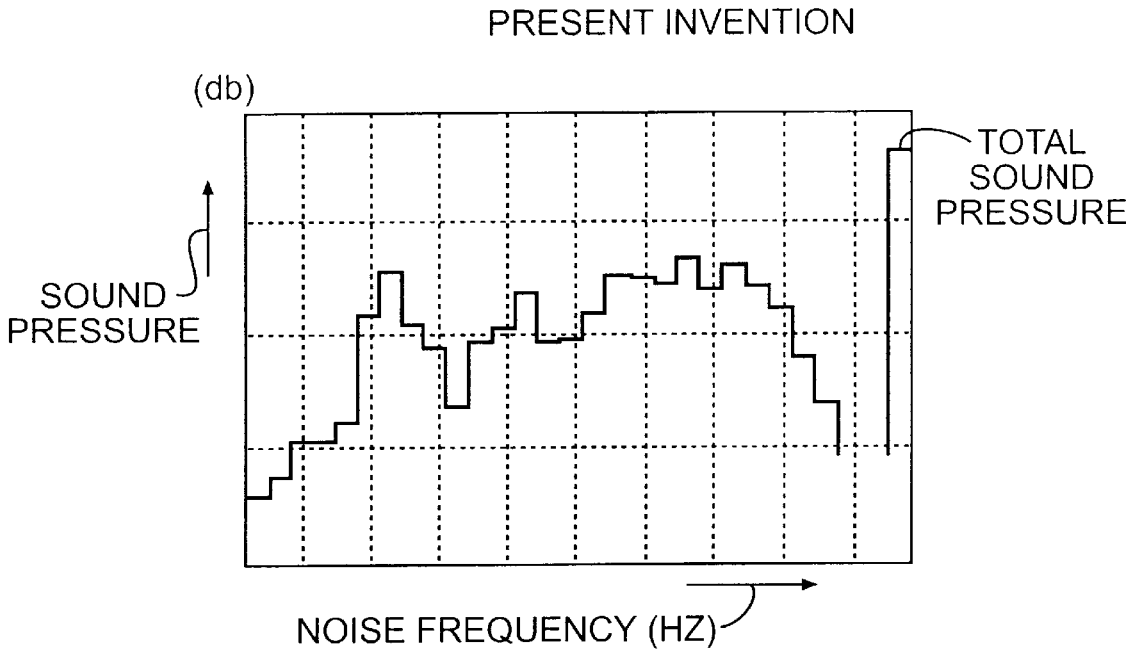
FIGS. 10(A) and 10(B) are graphs showing the comparison of noise caused by exhausted cooling while the motorcycle is idling and the cooling fan is operating.
Figure 10B:
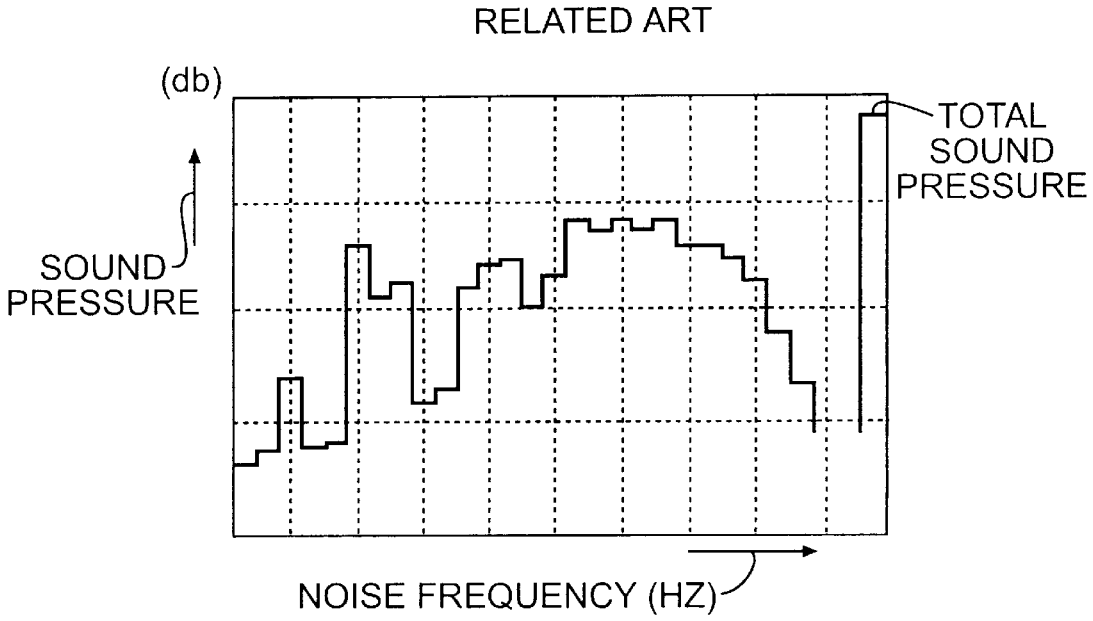

The graph in FIG. 10(A) and (B) show frequency distribution of sound pressure of noise caused by exhausted cooling air when the cooling fan 4 is operated while the motorcycle engine is idling. Overall sound pressure is shown at the right sides of these drawings. FIG. 10(A) relates to the present invention while FIG. 10(B) relates to the related art. It can be seen from these drawings that the present invention in FIG. 10(A) can extensively reduce noise caused by exhausted cooling air compared with the related art in FIG. 10(B). The level of noise is judged to be reduced to a level where noise is audible but can be ignored, through sensory inspection.

As clearly shown in FIGS. 8 to 10, the present invention can obtain a necessary amount of cooling air and reduce noise caused by exhausted cooling air as in the related art when the motorcycle is stationary and idling or it is operating at low speeds. This is accomplished for the following reasons: the shroud has the front and rear ends in the shape of a bell mouth; the bell mouth shaped inlet 11 is spaced from the rear surface of the radiator 1; and the space 16 is open toward the front peripheral edge of the shroud 8.

The bell mouth shaped outlet 11 is effective in smoothly dispersing exhausted cooling air rearward. The difference between the maximum and minimum diameters of the bell mouth shaped outlet 11 and the length B of the shroud 8 is in the ratio of 1:3–5, preferably approximately 1:4. This is most effective in maintaining the necessary amount of cooling air using the shroud, and in reducing noise caused by exhausted cooling air. The foregoing ratio is most useful to an actual manufacturing process.

Although not clearly shown in FIGS. 8 to 10, the presence of the bell mouth shaped portions, open space 16 and clearance 15 can allow cooling air, which is superfluous to the shroud 8, to advance rearwardly via the space 16 and the clearance 15 without going to the shroud 8. Further, cooling air passing through the radiator 1 except for areas around the shroud 8 can advance rearwardly without via the shrouds. Therefore, even when a large amount of an airstream is generated by the high speed operation of the motorcycle, it can smoothly pass through the radiator end the space 16, as cooling air. Therefore, even when the shroud 8 is present near the radiator 1, such airstreams can smoothly advance rearwardly through the space 16 regardless of the presence of the shroud 8. The cooling device of the invention can improve the cooling efficiency curing the operating of the motorcycle, compared with the case where the shroud entirely covers the rear surface of the radiator.

Further, the necessary amount of cooling air can be maintained or increased, and the reduction of noise caused by exhausted cooling air can be accomplished by the following measures the clearance C is made smaller between the straight portion 12 and the side edge of the impeller 7; the clearance D is maintained to be several millimeters, e.g. preferably 2 to 3 millimeters, between the edge of the bell mouth shaped inlet 10 and the rear surface of the radiator; the clearance E is maintained equal to or more than O between the edge of the bell mouth shaped output 11 and the rear edges of the impeller 7; the sufficient clearance F is maintained between the rear edge of the impeller 7 and the motor mounting stays 14; and the clearance G is maintained to be large between the front edge of the impeller 7 and the rear surface of the radiator 1 so as not to make the impeller 7 project to the bell mouth shaped inlet 10. Further, the stays 13 and the motor mounting motor stays 14 are attached to the outer peripheral edge of the shroud 8, thereby efficiently reducing noise caused by exhausted cooling air.

Figure 11A:
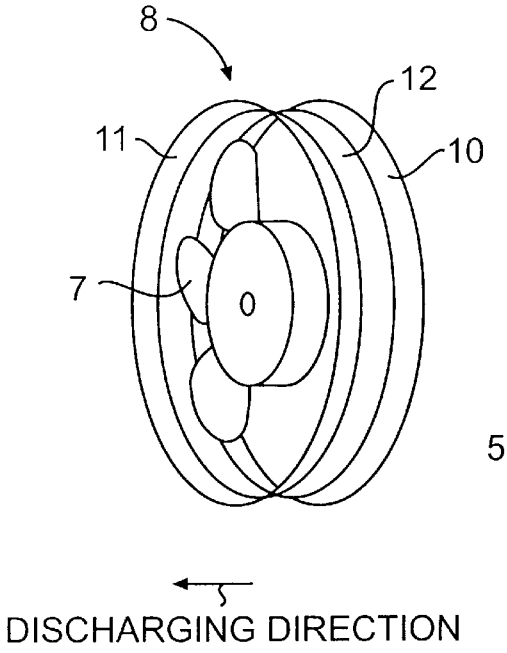
FIGS. 11(A) and 11(B), hereinafter referred to; as FIG. 11, show main parts of the cooling device in the second embodiment.
Figure 11B:
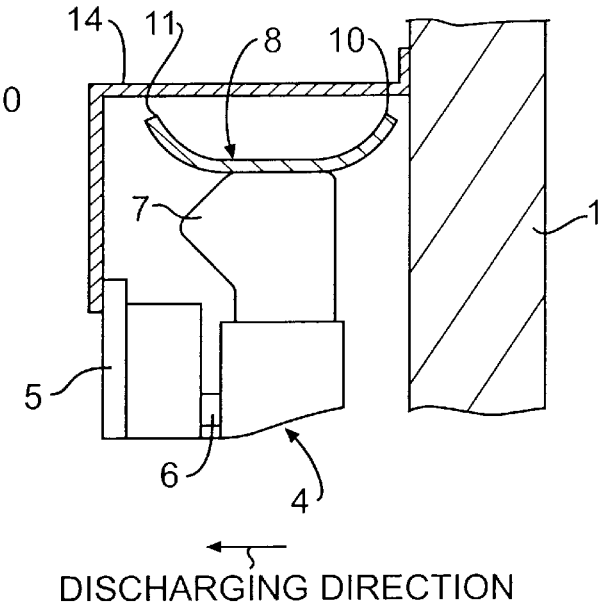

FIGS. 11(A) and 11(B) show a cooling device in a second embodiment of the invention. Specifically, FIGS. 11(A) and 11(b) are similar to FIG. 3(A), and FIG. 3(B), respectively. In the following description, members identical to those in the foregoing embodiment are assigned identical reference numerals.

In the second embodiment, the shroud 8 having an inlet and an outlet in the shape of a bell mouth is integral with the side edge of the impeller 7. Further, the motor 5 is directly attached to the radiator 1 using the motor mounting stays 14. Therefore, the shroud 8 rotates integrally with the impeller 7. The cooling device of the second embodiment is substantially identical to that of the first embodiment in the other respect including the bell mouth structure of the inlet and outlet of the shroud 8, and will not described here in detail.

Therefore, there is no clearance between the shroud 8 and the side edge of the impeller 7, which is effective in reducing noise pressure and accelerating exhausted cooling air. Further, the effects of the bell mouth structure of the shroud 8 is assured. Alternatively, the shroud 8 may be attached to the rotation shaft 6 in place of the impeller 7.

The motor mounting stays 14 can directly couple the motor 5 of the cooling fan to the radiator 1 without via the shroud 8, which is effective in simplifying the structure and decreasing weight of the cooling device.

Figure 13A:
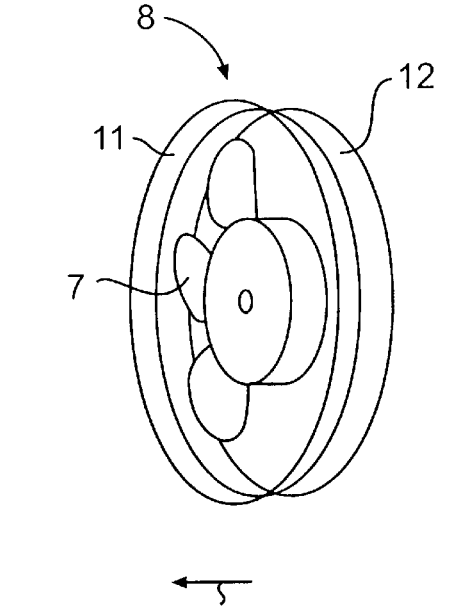
FIGS. 13(A) and 13(B), hereinafter referred to as FIG. 13, show main parts of the cooling device in the fourth embodiment.
Figure 13B:
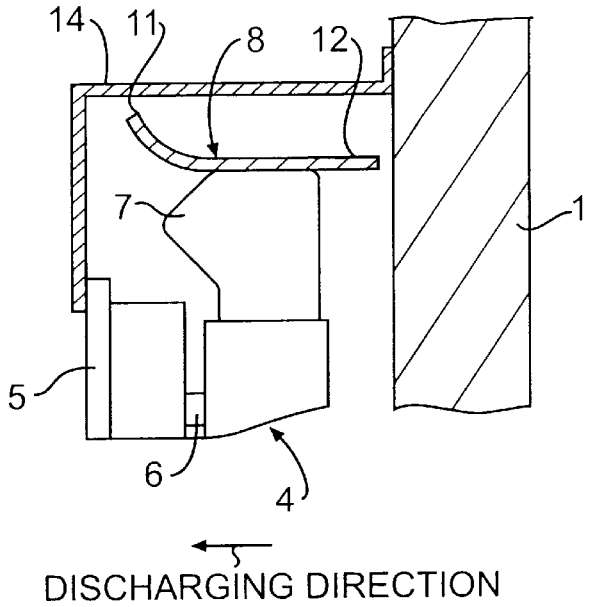
Figure 14A:
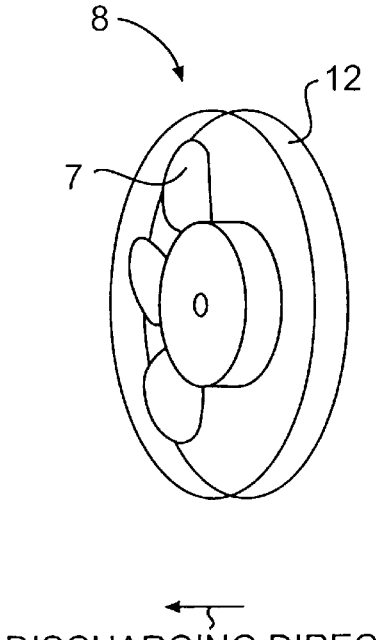
FIGS. 14(A) and 14(B), hereinafter referred to as FIG. 14, show main parts of the cooling device in the fifth embodiment.
Figure 14B:
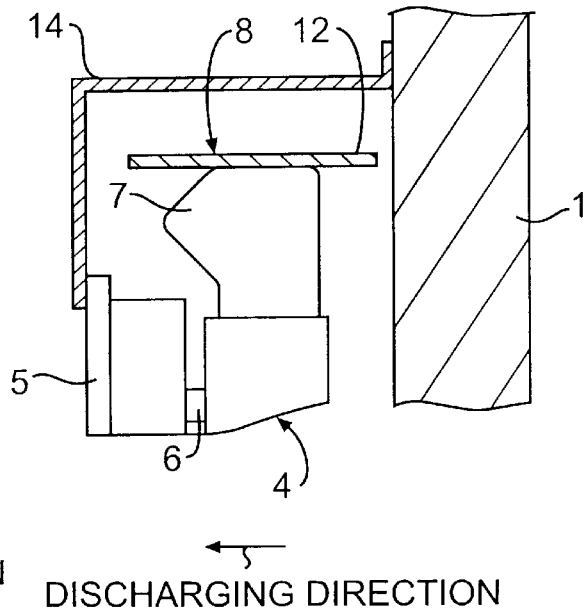

FIGS. 12 to 14 relate to modified examples of the cooling device shown in FIG. 11. They are identical in that the shroud 8 rotates integrally with the impeller 7. These drawings show the cooling fans similarly to FIGS. 11(A) and 11(B).

Figure 12A:
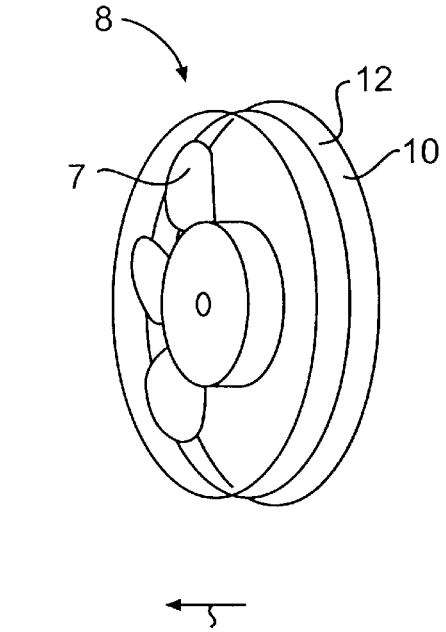
FIGS. 12(A) and 12(B), hereinafter referred to as FIG. 12, show main parts of the cooling device in the third embodiment.
Figure 12B:
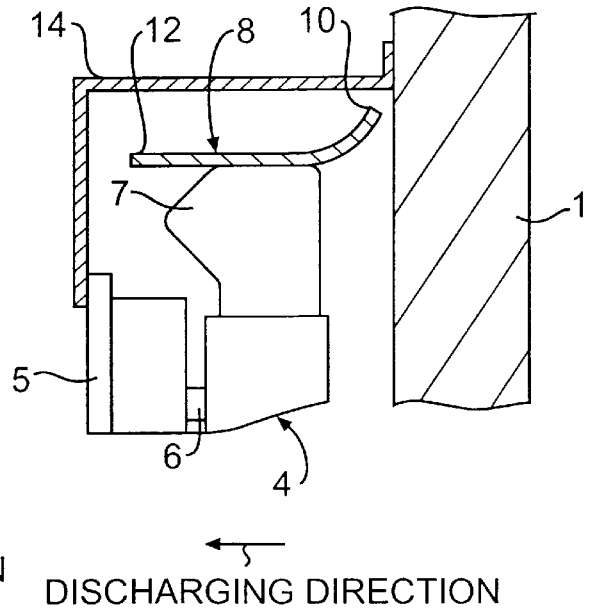

In a third embodiment shown in FIGS. 12(A) and 12(B), only the inlet 10 of the shroud 8 is in the shape of a bell mouth. The bell mouth shaped inlet 10 is expected to smoothly guide and disperse exhausted cooling air.

Referring to FIGS. 13(A) and 13(B) showing a fourth embodiment, only the outlet 11 of the shroud 8 is in the shape of a bell mouth while the inlet 10 is straight. This structure is effective in reducing sound pressure and maintaining the necessary amount of cooling air to a certain degree.

In the embodiments shown in FIGS. 11 to 13, the ratio A:B is 1:3 to 5, preferably 1:4, where A denotes a difference between maximum and minimum diameters of the bell-mouthed portion (i.e. the outlet when both the outlet and inlet of the shroud are in the shape of a bell mouth) of the shroud 8, and B denotes the length of the shroud 8. These embodiments not only assure the advantage obtained by integrating the shroud 8 and the impeller 7 but also are effective in maintaining the necessary amount of cooling air and reducing noise caused by exhausted cooling air through the use of the shroud having the bell mouth structure. The foregoing ratio can be set in a range which is advantageous for actual manufacturing of the cooling device.

As shown in FIG. 14, in a fifth embodiment, the shroud 8 has only the straight portion 12. This embodiment is free from the advantages accomplished by the bell mouth structure, and is not so effective as the foregoing embodiments. However, since the shroud 8 is integral with the impeller 7, i.e. there is no clearance between these members, this embodiment is expected to be effective in reducing sound pressure and maintaining the necessary amount of cooling air.

Figure 15:
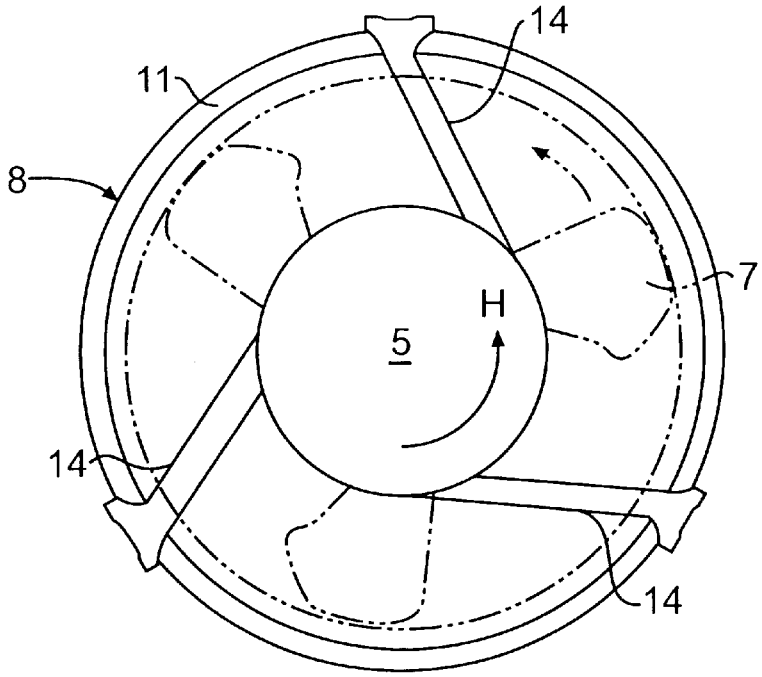
FIG. 15 shows a main part of the cooling device in the sixth embodiment.

FIG. 15 is a rear view showing the arrangement of the motor mounting stays in a sixth embodiment of the invention. As shown, the motor mounting stays 14 are inclined in the rotating direction (shown by arrow H) of the impeller 7. This arrangement is effective in reducing noise caused by exhausted cooling air because exhausted cooling air is turned by the impeller 7 and brought into contact with the motor mounting stays 14 with little resistance.

Figure 16:
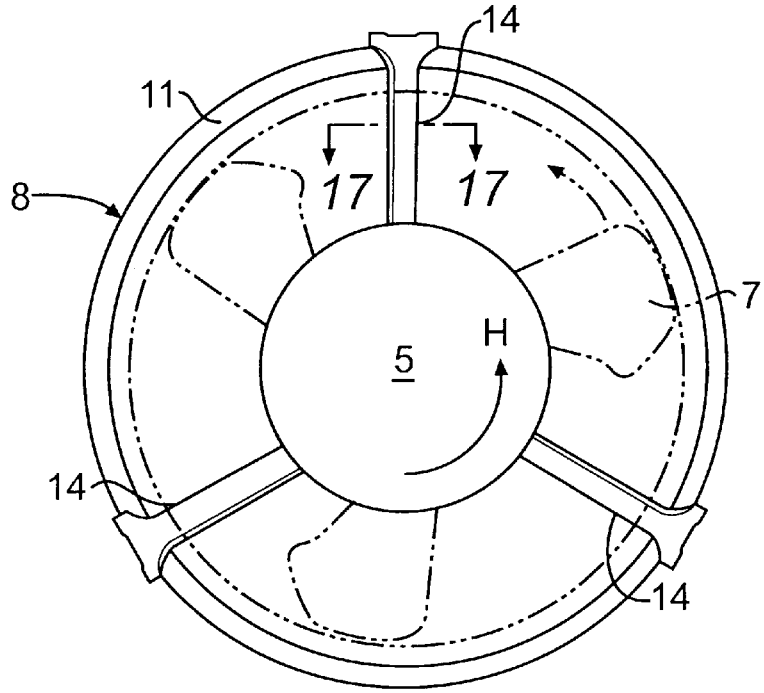
FIG. 16 shows a main part of the cooling device in the seventh embodiment.
Figure 17:
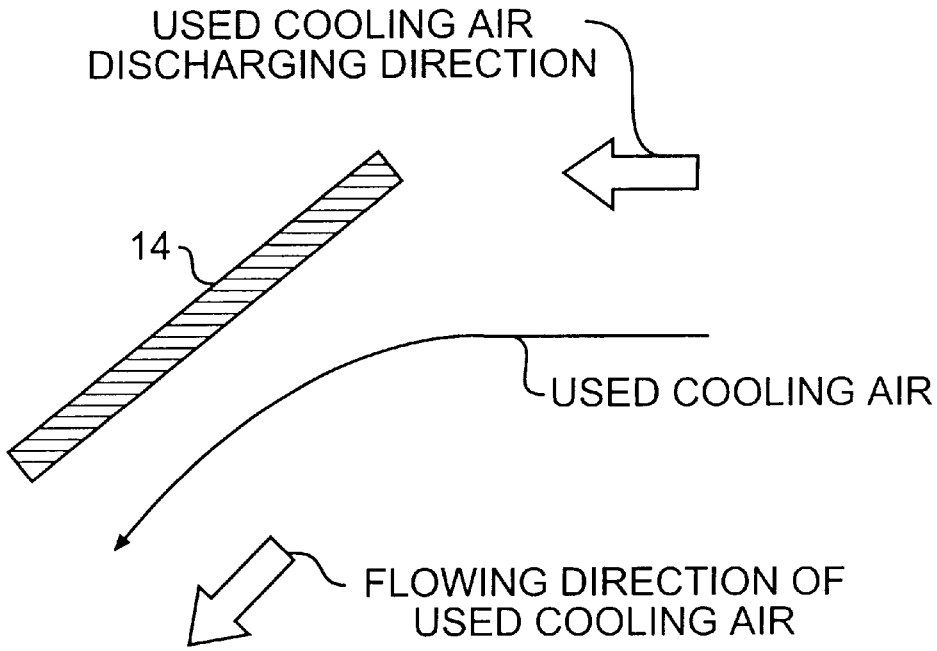
FIG. 17 is a sectional view taken along line 17—17 in FIG. 6.

A modified example of the sixth embodiment is shown in FIG. 16. The motor mounting stays 14 is not inclined in the rotating direction of the impeller. However, the motor mounting stays 14 are in the shape of a flat plate, and inclined in a direction where cooling air from the bell mouth shaped outlet of the shroud is to be guided finally.

The modified example is effective in reducing resistance with which cooling air is brought into contact the motor mounting stays and changing the flowing direction of cooling air like louvers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cooling device for a motorcycle radiator comprising:

a cooling fan having an impeller being positioned at a cooling air outlet of the radiator;

a cylindrical shroud surrounding the impeller of the cooling fan;

said cylindrical shroud having an inlet and an outlet formed in the shape of a bell mouth;

said bell mouth shaped inlet being positioned near the rear surface of the radiator with a clearance maintained therebetween;

a space communicating with said clearance is formed inside said inlet, said space being located between said impeller and said radiator and opening around the shroud through said clearance; and wherein a difference between a maximum diameter and a minimum diameter of the bell mouth shaped outlet of the shroud and a length of the shroud is in the ratio of 1:3 to 5.

2. The cooling device according to claim 1, wherein said ratio is 1:4.

3. The cooling device according to claim 1, wherein said shroud includes a straight portion located between said inlet and said outlet, and said impeller has a depth substantially equal to a length of said straight portion.

4. A cooling device for a motorcycle radiator comprising:

a cooling fan having an impeller being positioned at a cooling air outlet of the radiator; and a cylindrical shroud surrounding the impeller of the cooling fan;

wherein a bell mouth shaped inlet of the shroud is positioned near the rear surface of the radiator with a space maintained therebetween, said shroud being rotatable integrally with the impeller of the cooling fan, and a difference between a maximum diameter and a minimum diameter of the bell mouth shaped outlet of the shroud and a length of the shroud is in the ratio of 1:3 to 5.

5. The cooling device of claim 4, wherein the shroud has at least one of an inlet and an outlet thereof in the shape of a bell mouth.

6. The cooling device of claim 4, wherein the shroud has both an inlet and an outlet thereof in the shape of a bell mouth.

7. The cooling device according to claim 4, wherein said ratio is 1:4.

8. The cooling device according to claim 5, wherein said shroud includes a straight portion located between said inlet and said outlet, and said impeller has a depth substantially equal to a length of said straight portion.

9. A cooling device for a motorcycle radiator comprising:

a housing for positioning a cooling fan, said cooling fan including an impeller being positioned adjacent to a cooling air outlet of the radiator;

a cylindrical shroud being mounted on a peripheral portion of the impeller of the cooling fan to rotate together therewith;

said cylindrical shroud having an inlet and an outlet formed in the shape of a bell mouth;

said bell mouth shaped inlet being positioned near the rear surface of the radiator with a space maintained therebetween; and wherein a difference between a maximum diameter and a minimum diameter of the bell mouth shaped outlet of the shroud and a length of the shroud is in the ratio of 1:3 to 5.

10. The cooling device according to claim 9, wherein said ratio is 1:4.

11. The cooling device according to claim 9, wherein said shroud includes a straight portion located between said inlet and said outlet, and said impeller has a depth substantially equal to a length of said straight portion.

12. A cooling device for a motorcycle radiator comprising:

a cooling fan having an impeller being positioned at a cooling air outlet of the radiator; and a cylindrical shroud surrounding and being secured to an impeller of the cooling fan;

wherein a bell mouth shaped inlet of the shroud is positioned near the rear surface of the radiator with a space maintained therebetween, said shroud being rotatable integrally with the impeller of the cooling fan, and a difference between a maximum diameter and a minimum diameter of the bell mouth shaped outlet of the shroud and a length of the shroud is in the ratio 1:3 to 5.

13. The cooling device of claim 12, wherein the shroud has at least an inlet and an outlet thereof in the shape of a bell mouth.

14. The cooling device of claim 12, wherein the shroud has both an inlet and an outlet thereof in the shape of a bell mouth.

15. The cooling device according to claim 12, wherein said ratio is 1:4.

16. The cooling device according to claim 13, wherein said shroud includes a straight portion located between said inlet and said outlet, and said impeller has a depth substantially equal to a length of said straight portion.

* * * * *